US010197946B2

(12) United States Patent
Nagura et al.

(10) Patent No.: US 10,197,946 B2
(45) Date of Patent: Feb. 5, 2019

(54) DEVELOPING APPARATUS AND IMAGE FORMING APPARATUS HAVING OPPOSITE DIRECTION DEVELOPER CONVEYING PORTIONS

(71) Applicant: CANON FINETECH NISCA INC., Misato-shi (JP)

(72) Inventors: Hideo Nagura, Yoshikawa (JP); Ryo Nakajima, Nagareyama (JP); Chihiro Tanaka, Kashiwa (JP)

(73) Assignee: CANON FINETECH NISCA INC., Misato-shi (JP)

( * ) Notice: Subject to any disclaimer, the term of this patent is extended or adjusted under 35 U.S.C. 154(b) by 0 days.

(21) Appl. No.: 15/079,232

(22) Filed: Mar. 24, 2016

(65) Prior Publication Data

US 2016/0306294 A1 Oct. 20, 2016

(30) Foreign Application Priority Data

Apr. 16, 2015 (JP) ..... 2015-084134
Feb. 19, 2016 (JP) ..... 2016-029601

(51) Int. Cl.
*G03G 15/08* (2006.01)

(52) U.S. Cl.
CPC ..... *G03G 15/0893* (2013.01); *G03G 15/0891* (2013.01)

(58) Field of Classification Search
CPC ..... G03G 15/0893; G03G 15/0891; G03G 15/0887; G03G 15/0889
(Continued)

(56) References Cited

U.S. PATENT DOCUMENTS 4,344,692 A * 8/1982 Oda ..... G03G 15/0877 366/325.8
6,026,263 A * 2/2000 Nakahata ..... G03G 15/0822 399/102
(Continued)

FOREIGN PATENT DOCUMENTS

JP H08-030084 A 2/1996
JP H09-96957 A 4/1997
(Continued)

OTHER PUBLICATIONS

English machine translation to JP 2008-058814, Morita.*
(Continued)

*Primary Examiner* — Walter L Lindsay, Jr.
*Assistant Examiner* — Arlene Heredia
(74) *Attorney, Agent, or Firm* — Venable LLP

(57) ABSTRACT

A developing apparatus includes a rotary shaft member, a sheet member including a first developer conveying portion, an internal edge of which is held by the rotary shaft member, and which conveys developer in a first direction along a rotary shaft of the rotary shaft member, and a second developer conveying portion which conveys the developer in a second direction opposite to the first direction along the rotary shaft. The second developer conveying portion has an internal edge held by the rotary shaft member, and the rotary shaft member is radially disposed between the internal edges of the first and second developer conveying portions. In addition, a reinforcing unit reinforces the sheet member so as to have different degrees of reinforcement with respect to each of the first and second developer conveying portions.

14 Claims, 6 Drawing Sheets

(58) Field of Classification Search
USPC ..... 399/258, 263, 262, 254
See application file for complete search history.

(56) References Cited

U.S. PATENT DOCUMENTS

| | | | | |
|---|---|---|---|---|
| 7,899,367 | B2 | 3/2011 | Fukuta | |
| 9,164,427 | B2 | 10/2015 | Kobayashi | |
| 2002/0025192 | A1* | 2/2002 | Matsuda | G03G 15/0898 399/258 |
| 2003/0063927 | A1* | 4/2003 | Wang | G03G 15/0875 399/263 |
| 2005/0008400 | A1* | 1/2005 | Tazawa et al. | G03G 15/0875 399/263 |
| 2006/0222414 | A1* | 10/2006 | Yamamura | G03G 15/0822 399/263 |
| 2007/0196135 | A1* | 8/2007 | Fukuta | G03G 15/0877 399/254 |
| 2010/0196059 | A1* | 8/2010 | Maeshima | G03G 15/0868 399/263 |
| 2015/0063878 | A1* | 3/2015 | Torimoto | G03G 15/0889 399/263 |

FOREIGN PATENT DOCUMENTS

| | | | | |
|---|---|---|---|---|
| JP | 2002-040788 | A | | 2/2002 |
| JP | 2005-352418 | A | | 12/2005 |
| JP | 2007-219410 | A | | 8/2007 |
| JP | 2008-058814 | A | | 3/2008 |
| JP | 2009-157000 | A | | 7/2009 |
| JP | 2010-032754 | A | | 2/2010 |
| JP | 2011191437 | A | * | 9/2011 |
| JP | 2013-246403 | A | | 12/2013 |
| JP | 2016118744 | A | * | 6/2016 |
| JP | 2016118745 | A | * | 6/2016 |
| JP | 2016118746 | A | * | 6/2016 |
| JP | 2016118747 | A | * | 6/2016 |
| JP | 2016118749 | A | * | 6/2016 |

OTHER PUBLICATIONS

Machine translation into English of JP 2005-352418 to Sakakawa et al.*

Hideo Nagura et al., U.S. Appl. No. 14/976,254, filed Dec. 21, 2015.

* cited by examiner

DEVELOPING APPARATUS AND IMAGE FORMING APPARATUS HAVING OPPOSITE DIRECTION DEVELOPER CONVEYING PORTIONS

BACKGROUND OF THE INVENTION

Field of the Invention

The present invention relates to a conveying unit of a developing apparatus used for an image forming apparatus, such as a copying machine, a printer, or a fax machine, having adopted an electrophotographic system. More specifically, the invention relates to a developing apparatus including a conveying unit having a simple configuration and capable of stirring, conveying, and replenishing developer, and an image forming apparatus including the developing unit.

Description of the Related Art

In the related art, in a case where developer housed in a developing apparatus is used and consumed, a developer replenishment system for replenishing developer anew is used in an electrophotographic image forming apparatus. An example of the developer replenishment system includes a system for replenishing developer by replacing a developer replenishment container, similar to a toner bottle, detachably attachable to the electrophotographic image forming apparatus.

For example, Japanese Patent Laid-Open No. H08-30084 describes a developing apparatus including two stirring-conveying members disposed in parallel and a circulation channel of developer formed. The two stirring-conveying members each include a spiral member fixed around a rotary shaft in order to prevent degraded toner with a low charging amount from unevenly accumulating in a developing apparatus.

However, since the developing apparatus described in Japanese Patent Laid-Open No. H08-30084 includes the two spiral rotary members disposed therein, a structure for rotating and driving each of the rotary members is required. There are problems, such as complexity, an increase in size, and an increase in cost.

Japanese Patent Laid-Open No. 2010-32754 describes a toner replenishing apparatus capable of moving toner to the center by constantly maintaining a direction of a tongue-shaped bend formed on a rotary stirring blade of a stirring member that conveys the toner in a toner housing portion to a toner replenishing portion.

However, the toner replenishing apparatus described in Japanese Patent Laid-Open No. 2010-32754 moves remaining toner in an end portion in a container to the center of the container so as to stir the toner. A sufficient stir is not performed with respect to the end portion side in a rotary shaft direction of the stirring member. Thus, there is a problem that an image without uneven density cannot be acquired.

SUMMARY OF THE INVENTION

A developing apparatus includes: a rotary shaft member; a sheet member having: a first developer conveying portion in which one end is held by the rotary shaft member, and which conveys developer in a first direction along a rotary shaft of the rotary shaft member; and a second developer conveying portion which conveys the developer in a second direction inverse to the first direction along the rotary shaft, at a position at which the rotary shaft member is closer to the second developer conveying portion than the first developer conveying portion; and a reinforcing unit which reinforces the sheet member so as to have the different degree of reinforcement with respect to each of the first and second developer conveying portions.

Further features of the present invention will become apparent from the following description of exemplary embodiments with reference to the attached drawings.

DESCRIPTION OF THE EMBODIMENTS

First Embodiment (Configuration of Developing Apparatus)

Figure 1:
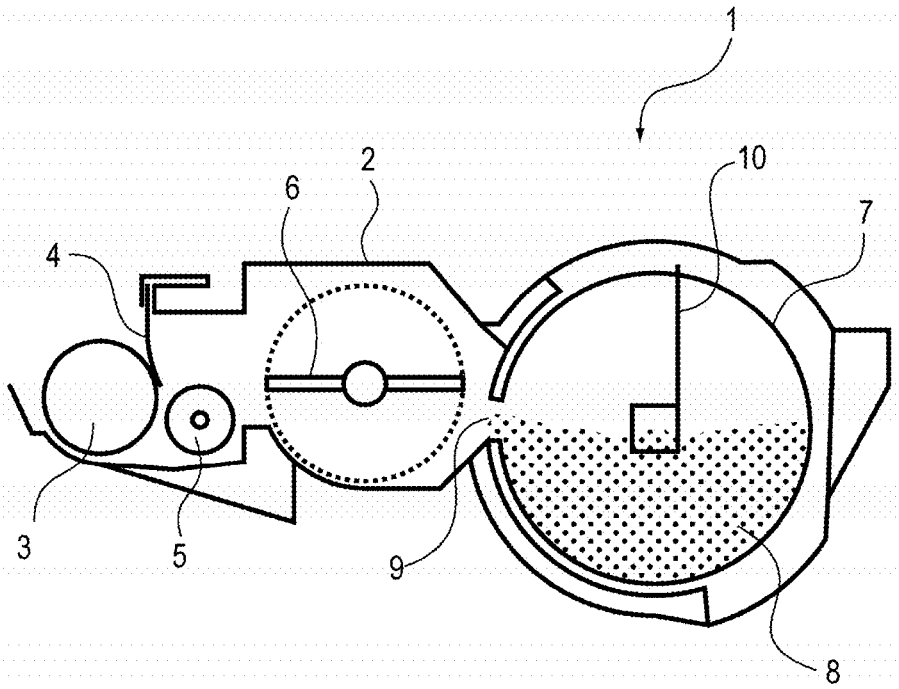
FIG. 1 is a schematic view of a developing apparatus according to a first embodiment of the present invention.

FIG. 1 is a schematic view of a developing apparatus 1 according to a first embodiment of the present invention. The developing apparatus 1 is an apparatus used for an image forming apparatus, such as a copying machine, a printer, or a fax machine, having adopted an electrophotographic system. A developer container 2 as a developer housing container includes a developing roll 3 as a developer bearing member that has enveloped a magnet for bearing and conveying developer for visualizing an electrostatic latent image formed on a photosensitive drum surface that is an image bearing member and is not illustrated.

The developing apparatus 1 includes a developing blade 4 and a toner conveying member 5. The developing blade 4 electrifies toner 8 as the developer and also regulates a toner layer formed on a surface of the developing roll 3. The toner conveying member 5 replenishes the toner 8 to the developing roll 3. Furthermore, as a member for conveying the developer in the developer housing portion, the developer container 2 includes a conveying unit 6 that conveys the toner 8 to the toner conveying member 5.

A toner bottle 7 is a developer replenishing portion detachably attachable to the developer container 2. The developer replenishing portion houses the magnetic single component toner 8, and includes a toner replenishment port 9 that is an opening for replenishing the developer container 2 with the toner 8. The toner bottle 7 includes a stirring member 10 capable of rotating inside. The stirring member 10 replenishes the toner 8 in the toner bottle 7 to the developer container 2 through the toner replenishment port 9. The toner 8 that has been replenished is conveyed to the side of the developing roll 3 while being stirred by the conveying unit 6 that rotates inside the developer container 2.

Figure 2:
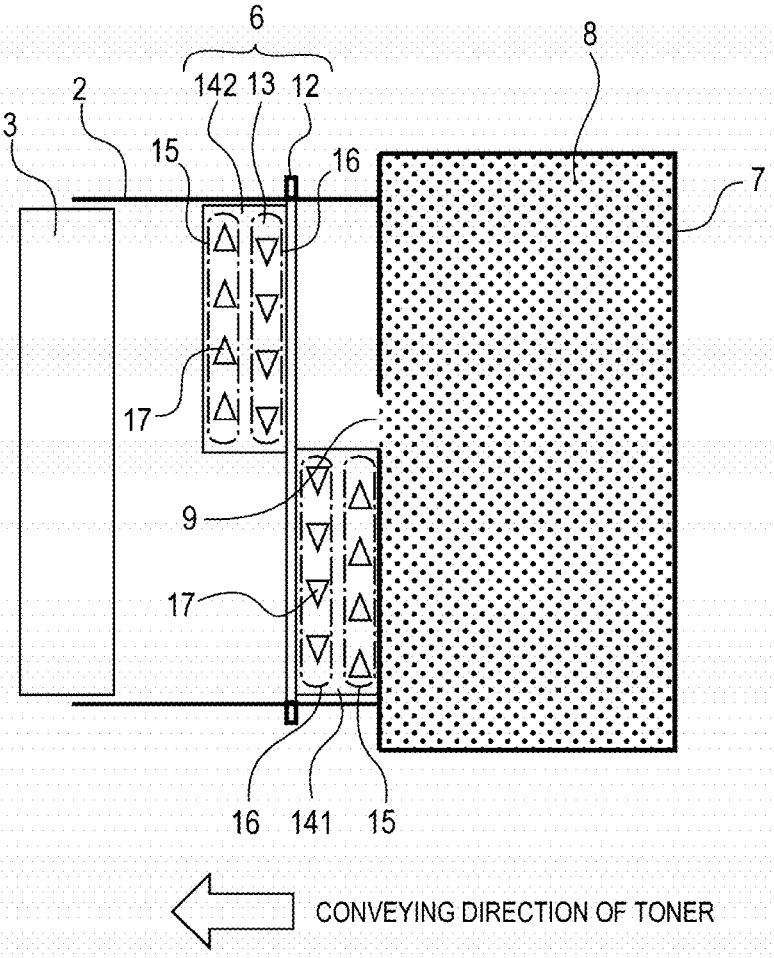
FIG. 2 is a schematic view of an internal configuration of a developer container including a toner bottle fixed thereto when viewed from the upper side.

FIG. 2 is a schematic view for describing a plurality of developer conveying portions included in the conveying unit 6. FIG. 2 is the schematic view of the inside of a configuration of the developer container 2 including the toner bottle 7 fixed thereto so that the toner replenishment port 9 and the conveying unit 6 can face each other when viewed from the upper side.

The conveying unit 6 includes a rotary shaft member 12 and a sheet member 14. The rotary shaft member 12 extends in a direction similar to a rotary shaft direction of the developing roll 3. The sheet member 14 includes a conveying surface 13 having a side perpendicular to the rotary shaft member 12 and a side in an axial direction of the rotary shaft member 12. The sheet member 14 is fixed to the rotary shaft member 12, and is disposed so as to be rotatable around the rotary shaft member 12 inside the developer container 2 that is the developer housing portion. In accordance with a rotating movement of the sheet member 14, the side of a rotary end of the sheet member 14 conveys the toner 8 that is the developer, from the developer container 2 to the side of the developing roll 3.

The sheet member 14 includes the developer conveying portions 15 and 16 that convey the toner 8 in the axial direction of the rotary shaft member 12, between an end portion of the rotary center side and an end portion of the rotary leading end side in a direction of a radius of rotation. In a case where the number of sheet members 14 is one, loads simultaneously act on the same portion in the axial direction. Arranging the plurality of sheet members 14 can achieve load distribution.

As two sheet members 14, a first sheet member 141 that is a first conveying member and a second sheet member 142 that is a second conveying member are disposed, with respect to the rotary shaft member 12, so as to form a different rotation angle around the rotary shaft member 12. The plurality of sheet members 14 is disposed so as to have the same rotation angle difference near the rotary shaft member 12. Thus, a load in a direction of rotation can be further uniformly distributed.

Furthermore, the first sheet member 141 and the second sheet member 142 are moved in the axial direction of the rotary shaft member 12 and are disposed on the rotary shaft member 12 so as to have a positional relationship in which the first sheet member 141 and the second sheet member 142 are not overlapped with respect to a direction of rotation of the rotary shaft member 12. In addition, the sheet members 141 and 142 are disposed so that ends on the center side in the axial direction of the two sheet members 141 and 142 each face the toner replenishment port 9.

The developer container 2 stores the toner 8 to be conveyed from the toner replenishment port 9 to the toner conveying member 5, below the rotary shaft member 12 of the conveying unit 6. A conveying surface 13 of each of the sheet members 141 and 142 includes a plurality of developer conveying portions that conveys and moves the toner 8 in the axial direction of the rotary shaft member 12 by rotating the rotary shaft member 12 in a direction from the toner replenishment port 9 to the toner conveying member 5 through the internal lower side of the developer container 2.

(Configuration of Developer Conveying Unit)

As the plurality of developer conveying portions, the first developer conveying portion 15 and the second developer conveying portion 16 are formed on the conveying surface 13 of each of the first sheet member 141 and the second sheet member 142 so as to extend in the axial direction of the rotary shaft member 12. The first developer conveying portion 15 of each of the two sheet members 141 and 142, is provided with the second developer conveying portion 16 so as to be disposed on the leading side of rotation of the second developer conveying portion 16 in the direction of a radius of rotation of the rotary shaft member 12.

Each of the first developer conveying portion 15 and the second developer conveying portion 16 includes a plurality of predetermined-shaped openings 17 to be described below disposed in a line on the developer conveying surface 13 of the sheet member 14. Accordingly, a conveying direction of the toner 8 by the first developer conveying portion 15 and a conveying direction of the toner 8 by the second developer conveying portion 16 are made to be mutually inverse with respect to the axial direction of the rotary shaft member 12.

Each of the plurality of openings 17 has a shape in which a size of an opening (opening width) perpendicular to a toner conveying direction in the axial direction, gradually increases. Once the conveying surface 13 moves rotationally around a shaft of the rotary shaft member 12, when the toner 8 pushed and moved to the conveying surface 13 passes through the opening 17 from the front side to the back side of the conveying surface 13 (from the front side to the back side in a direction of rotation), the toner 8 moves from a small opening width to a large opening width of the opening 17. Toner conveying force in a predetermined direction occurs due to the movement of the toner 8. As described above, in a direction in which pressure from the toner 8 decreases with respect to the conveying surface 13 to be rotated, namely, in a direction in which the opening width increases, the toner 8 is pushed and moved to the conveying surface 13 so that toner conveyance is performed in the predetermined direction.

(Configuration of Opening)

Figure 3:
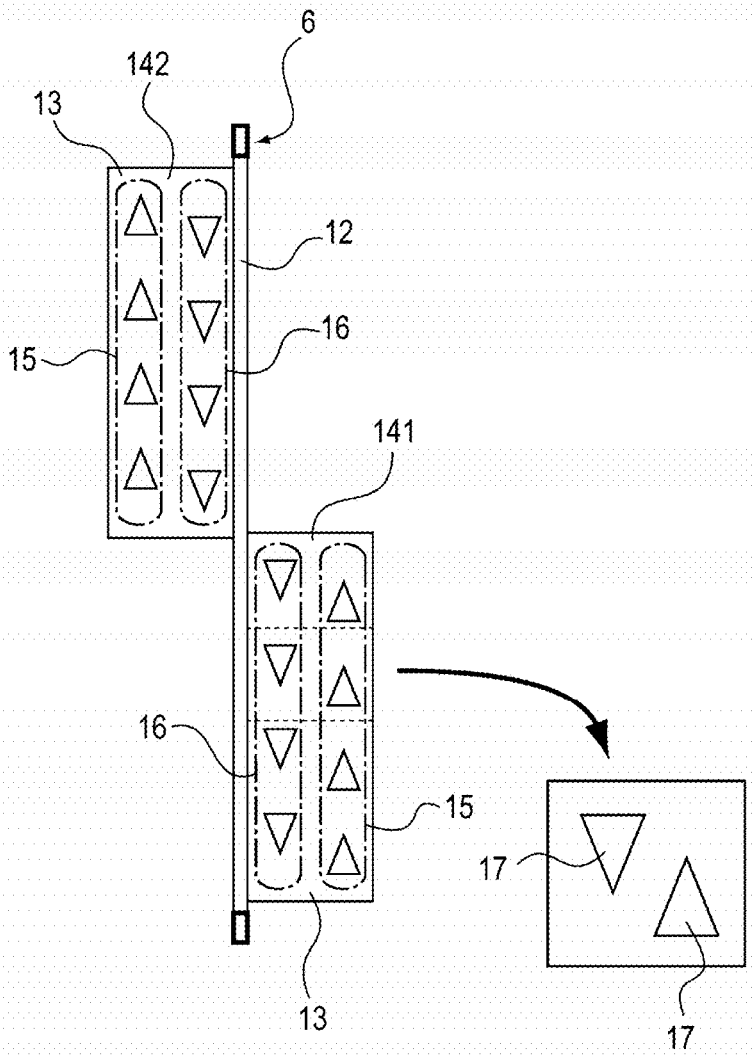
FIG. 3 is a schematic view of an opening formed on a conveying surface of a sheet member.

FIG. 3 is a schematic view of the opening 17 formed on the conveying surface 13 of each of the two sheet members 141 and 142 as the developer conveying portions.

The opening 17 has a shape in which the vertex of a triangle faces in a direction inverse to the conveying direction of the toner 8 so that the opening width increases in order to decrease the pressure of the toner 8 received by the conveying surface 13 (a shape in which the opening width widens in the conveying direction of the toner 8). There is a mutually reverse relationship between a direction of the vertexes of triangles of a plurality of openings 17 of the first developer conveying portion 15 and a direction of the vertexes of triangles of a plurality of openings 17 of the second developer conveying portion 16 on each of the sheet members 141 and 142.

Furthermore, the openings 17 of the first developer conveying portion 15 of the first sheet member 141 and the openings 17 of the first developer conveying portion 15 of the second sheet member 142, face in the same direction in the axial direction of the rotary shaft member 12. Similarly, the openings 17 of the second developer conveying portion 16 of the first sheet member 141 and the openings 17 of the second developer conveying portion 16 of the second sheet member 142, face in the same direction in the axial direction of the rotary shaft member 12.

Figure 4:
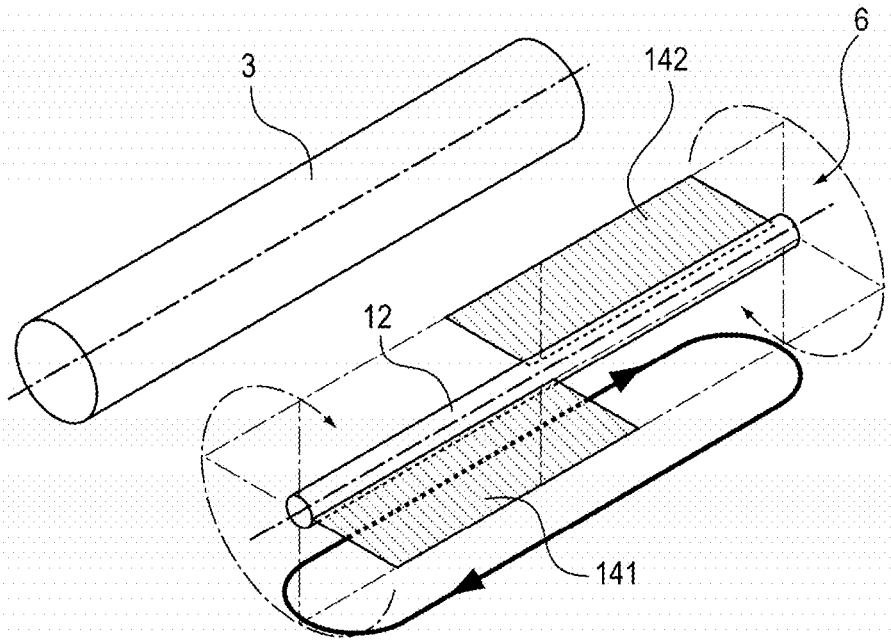
FIG. 4 is a schematic view of a conveying direction of developer by a developer conveying portion illustrated in FIG. 3.

FIG. 4 is a schematic view of a conveying direction of the toner 8 by the developer conveying portions 15 and 16 illustrated in FIG. 3.

With the configuration illustrated in FIG. 3, the toner 8 conveyed to the side of one end by the first developer conveying portion 15 of each of the two sheet members 141 and 142, is conveyed to the side of the other end in circulation by the second developer conveying portion 16 of each of the two sheet members 141 and 142. As a result, in accordance with the rotation of the conveying unit 6, the developer conveying portions 15 and 16 form a toner conveying channel along the conveying surface 13 of each of the two sheet members 141 and 142.

First, the toner 8 that has been conveyed, along the conveying surface 13 of the first sheet member 141, to the side of one end in the axial direction of the rotary shaft member 12 by the first developer conveying portion 15, is conveyed to the center side in the axial direction by the second developer conveying portion 16 of the next rotationally coming first sheet member 141. Then, the toner 8 is conveyed to the side of the other end in the axial direction by the second developer conveying portion 16 of the next rotationally coming second sheet member 142. After that, the toner 8 is again conveyed to the center side in the axial direction by the first developer conveying portion 15 of the next rotationally coming second sheet member 142.

With this configuration, in prevention of retention of the toner 8 at an end portion of the developer container 2, the toner 8 can be stirred so as to be further uniform. In addition, damage of the conveying unit 6 can be inhibited.

A state where the toner 8 has been uniformly stirred, is an effect acquired according to each of the above aspects and the present aspect. The state is ascertained by a small variation of reflection density of the toner 8 in the axial direction.

FIGS. 5A to 5F are schematic views of other aspects of the opening 17. In each of the above aspects, the triangle-shaped opening is used as the opening 17. The shape of opening is not limited to this, and may have each of configurations illustrated in FIGS. 5A to 5F. Shapes of the opening 17 and a cut portion 18 formed on the conveying surface 13 of each of the two sheet members 141 and 142, may be shapes that cause the movement of the toner 8 as in each of the above aspects by the rotation of the conveying unit 6 inside the developer container 2.

Figure 5A:
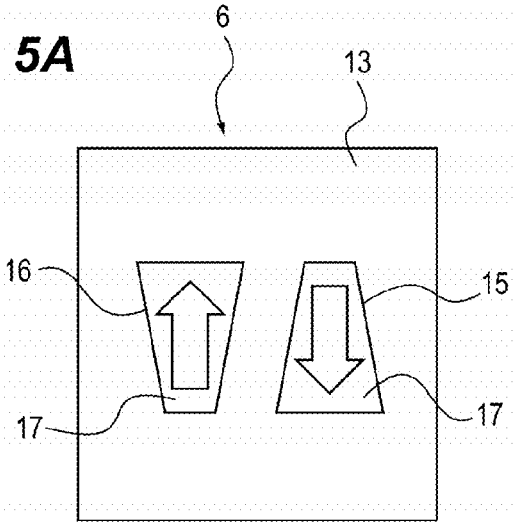
FIGS. 5A to 5F are schematic views of other aspects of an opening formed on a conveying surface of a sheet member.

FIG. 5A is the schematic view of a trapezoidal shape as the opening 17, instead of the triangle shape. An arrow in each of the figures indicates the conveying direction of the toner 8 in the axial direction of the rotary shaft member 12.

The trapezoidal shape is disposed on the conveying surface 13 so that the size of an opening (opening width) of the opening 17 increases in a direction in which the toner 8 is to be conveyed (the opening width widens in the conveying direction of the toner 8). That is, even when the trapezoidal-shaped opening 17 is disposed so as to position the upper base and the lower base of thereof in this order in the direction in which the toner 8 is to be conveyed, instead of each of the triangular openings 17 of the two developer conveying portions 15 and 16, a similar stirring effect of the toner 8 can be achieved.

Figure 5B:
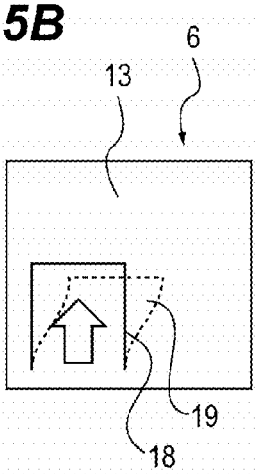
Figure 5C:
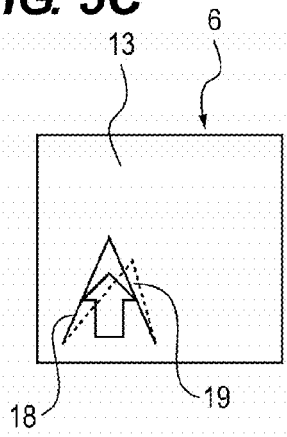
Figure 5D:
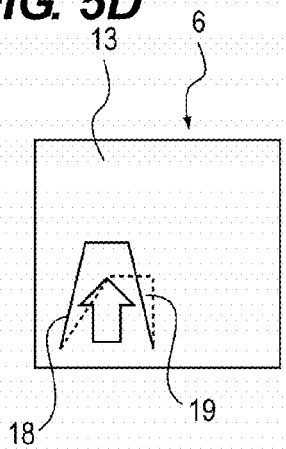

FIGS. 5B to 5D are the schematic views of cut portions 18 instead of the opening 17.

The conveying unit 6 bends backward in a direction of rotation around the rotary shaft member 12 in the direction in which the toner 8 is to be conveyed, so that the cut portion 18 forms an opening. The two developer conveying portions 15 and 16 each may include the cut portion 18 formed thereon Due to the cut portion 18, the conveying surface 13 of each of the two sheet members 141 and 142 acts as a bending portion 19 in accordance with the rotation of the conveying unit 6. The cut portion 18 has a shape by which the toner 8 moves from a region in which there is no cut, to the side of a bending one-side leading end of the cut portion 18 due to the pressure of the toner 8 to be received. The toner 8 moves in a direction in which the opening of the cut portion 18 is formed by the bend of the bending portion 19 when the pressure of the toner 8 is added to the conveying surface 13. Thus, the toner 8 is conveyed in an individual predetermined direction.

Examples of the shape of the opening formed by bending the bending portion 19 in the cut portion 18 may include a substantially U-shape, or a triangular shape or a trapezoidal shape in which an opening width decreases in the conveying direction of the toner 8 (refer to FIGS. 5B to 5D).

In a case where a substantially U-shaped cut is applied, the bending portion 19 bends from the side on which there is no cut, to the facing side formed by the cut, due to the pressure of the toner 8. As described above, the toner 8 moves to the cut portion 18 that has bent so that the toner 8 can be conveyed.

In a case where a triangle-shaped cut is applied, the cut is formed from the side of the base to the vertex of the triangle in order to bend easily by the pressure of the toner 8. The toner 8 is conveyed from the base to the vertex of the triangle.

In a case where a trapezoid-shaped cut is applied, for the same reason, the cut is formed from the lower base to the upper base. The toner 8 is conveyed from the lower base to the upper base. The number of sides of the trapezoidal shape is larger than those of the triangular shape. Thus, the size of the opening perpendicular to the toner conveying direction (opening width) can be easily adjusted. Therefore, a toner conveying amount in which the toner 8 is conveyed and moved in the axial direction of the rotary shaft member 12, can be easily adjusted.

Note that, there is a reciprocal relationship between FIG. 5A and FIGS. 5B to 5D in terms of the conveying-and-moving direction of the toner 8 with respect to the opening width. This is because conveying force of the toner 8 due to the cut portion 18 exceeds conveying force of the toner 8 due to the difference of the opening width.

Figure 5E:
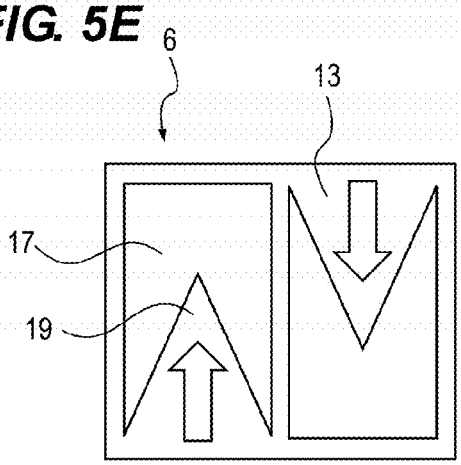
Figure 5F:
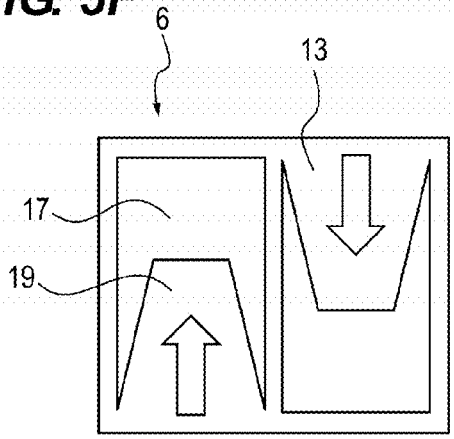

FIGS. 5E and 5F are schematic views of configurations each including, from a side on the downstream side to the upstream side in the toner conveying direction of an opening 17, an opening portion of the opening 17 remaining and a taper-shaped bending portion 19 disposed therein. The opening 17 is smaller than the opening portion of the opening 17. The taper-shaped bending portion 19 facing in a conveying direction of developer protrudes inside the opening 17. FIGS. 5E and 5F illustrate a triangular shape and a trapezoidal shape as examples of the taper-shaped bending portion 19, respectively.

With the configuration including the above bending portion 19 and the opening portion remaining on the downstream side of the toner conveying direction, the toner 8 is conveyed in a predetermined direction by a bend of the bending portion 19. In addition, a load of the toner 8 received by the sheet member 14 to be rotated can be appropriately reduced so that inhibition of toner conveying performance to the side of the developing roll 3 can be prevented.

Here, as the opening portion increases in size, the conveyance of the toner 8 in the predetermined direction is inhibited. Therefore, an appropriate size is selected for the opening portion, based on a relationship between the size of the bending portion 19 and rigidity of a material of the bending portion 19, including conditions, such as physical properties of the toner 8 and a speed of rotation of the sheet member 14.

(Configuration of Reinforcing Portion)

Figure 6:
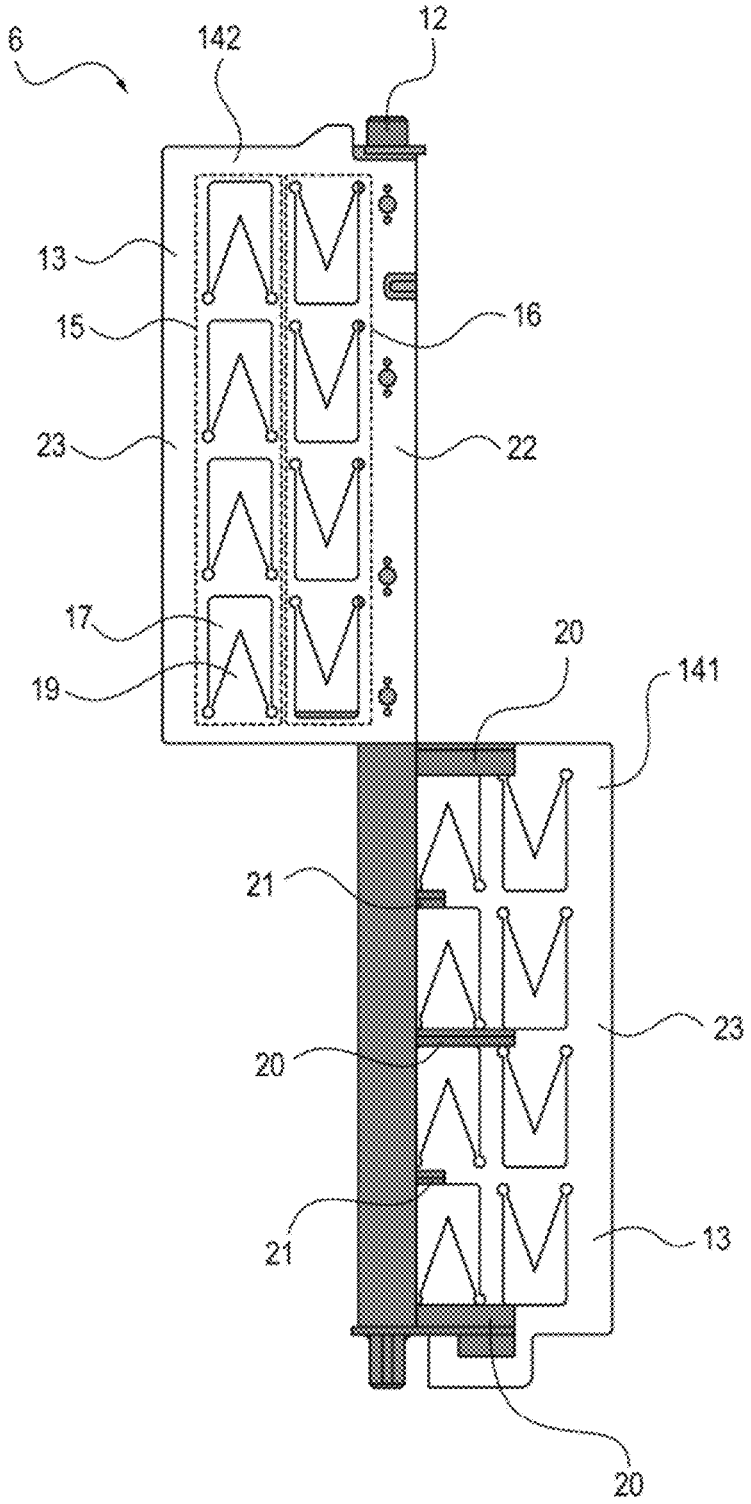
FIG. 6 is a schematic view of a sheet member including a reinforcing member disposed thereon.

FIG. 6 is a schematic view of the conveying unit 6 according to the first embodiment of the present invention. The conveying unit 6 includes the rotary shaft member 12 and the sheet member 14. The rotary shaft member 12 extends in the direction similar to the rotary shaft direction of the developing roll 3. The sheet member 14 includes the conveying surface 13 having a side perpendicular to the rotary shaft member 12 and a side in the axial direction of the rotary shaft member 12. The sheet member 14 is fixed to the rotary shaft member 12, and is disposed so that the sheet member 14 can rotate around the rotary shaft member 12 inside the developer container 2 that is the developer housing portion.

A side of an end portion of the rotary center side 22 fixed to the rotary shaft member 12, and a side of an end portion of the rotary leading end side 23 facing the side of the end portion of the rotary center side 22, are defined as the side in the axial direction of the rotary shaft member 12 of the sheet member 14. When the toner 8 is conveyed to the side of the developing roll 3 due to the rotation of the conveying unit 6, the end portion of the rotary leading end side 23 of the sheet member 14 enters into a portion in which the toner 8 that is the developer housed in the developer container 2 has been stored. Then, the end portion of the rotary leading end side 23 scoops the toner 8 so as to convey the toner 8 from the developer container 2 to the side of the developing roll 3.

Here, upon the conveyance of the toner 8 to the side of the developing roll 3, when a load is applied to the toner conveying surface 13 of the sheet member 14 and the sheet member 14 excessively bends, the toner conveying performance to the side of the developing roll 3 is degraded.

In addition, upon the stir of the toner 8 in the axial direction, when the sheet member 14 excessively bends, the opening 17 inclines in a direction in which the toner 8 enters so that a projected area decreases with respect to the toner 8. Therefore, the toner 8 to move decreases and stirring performance is degraded.

The bend of the sheet member 14 is adjusted by the length of a reinforcing portion abutting to the sheet member 14, based on the toner conveying performance to the side of the developing roll 3. In this case, when all reinforcing portions are made to have the same length, rigidity of a region of the first developer conveying portion 15 far from the center of rotation of the conveying unit 6 of the sheet member 142, is lower than that of a region of the second developer conveying portion 16 near to the center of rotation of the conveying unit 6. Therefore, a difference in bend between the first developer conveying portion 15 and the second developer conveying portion 16, occurs. In addition, a difference in conveying force of the toner 8 between a first axial direction and a second axial direction inverse to the first axial direction in a rotary shaft of the conveying unit 6, occurs. As a result, the conveying performance of the toner 8 becomes uniformed.

In the conveying unit 6, the degree of reinforcement of the first reinforcing portion 20 and the degree of reinforcement of the second reinforcing portion 21 are made to differ from each other and are adjusted. Thus, the un-uniformity between the conveying force of the toner 8 in the first axial direction by the first developer conveying portion 15 and the conveying force of the toner 8 in the second axial direction by the second developer conveying portion 16, is alleviated. In this case, the bending portion 19 of the sheet member 14 is adjusted so as to maintain the conveying performance of the toner 8 to the side of the developing roll 3.

Accordingly, the conveying unit 6 has a configuration in which the toner 8 in the developer container 2 can be sufficiently conveyed and stirred in a rotary shaft direction of the conveying unit 6, in addition, the conveying performance of the toner 8 to the side of the developing roll 3 in a radius direction of the conveying unit 6 can be adjusted.

The configuration will be described in more detail using FIG. 6. The openings 17 and the sheet-shaped bending portions 19 that bend inside the openings of the openings 17, illustrated in FIG. 5E, are disposed on each of the sheet members 141 and 142 illustrated in FIG. 6.

The first developer conveying portion 15 and the second developer conveying portion 16 are formed on the conveying surface 13 of each of the first sheet member 141 and the second sheet member 142. The first developer conveying portion 15 includes the opening 17 and the bending portion 19 arranged in a line in the rotary shaft direction of the rotary shaft member 12 in order to convey the toner 8 in a predetermined direction. The second developer conveying portion 16 includes the opening 17 and the bending portion 19 arranged in order to convey the toner 8 in a direction inverse to the toner conveying direction by the first developer conveying portion 15.

The first developer conveying portion 15 is provided with the second developer conveying portion 16 so as to be disposed on the leading end side of rotation of the second developer conveying portion 16 in the direction of a radius of rotation of the rotary shaft member 12. For example, the toner 8 is conveyed to the end portion side in the rotary shaft direction of the rotary shaft member 12 by the first developer conveying portion 15 of the sheet member 141. Furthermore, the toner 8 is conveyed to the center side in the rotary shaft direction of the rotary shaft member 12 by the second developer conveying portion 16.

Two types of the reinforcing portions 20 and 21 extending from the end portion of the rotary center side 22 with respect to the rotary shaft member 12 to the end portion of the rotary leading end side 23 of each of the sheet members 141 and 142 (in a direction of a radius of rotation of the sheet members 141 and 142), are disposed on each of the sheet members 141 and 142.

Since the sheet members 141 and 142 includes a flexible material, the sheet members 141 and 142 largely bend to the back side in the direction of rotation due to the load applied from the toner 8 upon the rotation. In this case, conveying force of the toner 8 to the side of the developing roll 3 due to the rotation of the sheet members 141 and 142, and conveying force of the toner 8 in the axial direction by the first developer conveying portion 15, are degraded. The first reinforcing portion 20 serves to adjust the bends. The first reinforcing portion 20 includes a material having rigidity equal to or more than that of the sheet members 141 and 142.

The first reinforcing portion 20 is disposed across from the end portion of the rotary center side 22 on each of the sheet members 141 and 142 to a region in which the first developer conveying portion 15 has been disposed through a region in which there is no opening 17.

The second reinforcing portion 21 serves to adjust a bending amount of each of the sheet members 141 and 142 with the first reinforcing portion 20. In addition, the second reinforcing portion 21 serves to adjust toner conveying force of the second developer conveying portion 16 in a direction inverse to toner conveying force of the first developer conveying portion 15.

The second reinforcing portion 21 is disposed across from the end portion of the rotary center side 22 on each of the sheet members 141 and 142 to a region in which the second developer conveying portion 16 has been disposed through a region in which there is no opening 17. The second reinforcing portion 21 is shorter than the first reinforcing portion 20 in length.

The second reinforcing portion 21 can adjust the above bending amount by selecting a length from the end portion of the rotary center side 22 and a material having rigidity equal to or more than that of the sheet members 141 and 142. That is, lengthening the length of the second reinforcing portion 21 or increasing the rigidity can decrease the bend of each of the sheet members 141 and 142 upon the rotation of the sheet members 141 and 142.

The first reinforcing portion 20 and the second reinforcing portion 21 are integrally formed and acquired with the rotary shaft member 12. Alternatively, as each of the first reinforcing portion 20 and the second reinforcing portion 21, a slender member formed of a material having predetermined rigidity may be fixed to the rotary shaft member 12 or each of the above positions of the sheet members 141 and 142. Furthermore, upon formation of the sheet members 141 and 142, the thicknesses at the above positions of the sheet members 141 and 142 may be formed so as to be thick as the first reinforcing portion 20 and the second reinforcing portion 21.

Second Embodiment

The conveying unit 6 having the first reinforcing portion 20 and the second reinforcing portion 21 that has been described in the first embodiment, can be used as the stirring member 10 disposed so as to be rotatable inside the toner bottle (toner cartridge) 7 that is a developer replenishment container replaceable to be fit to the developer container 2.

While stirring the toner 8 in the toner bottle 7, the stirring member 10 serves to convey the toner 8 to the toner replenishment port 9 for replenishing the toner 8 to the developer container 2. With the configuration described in the first embodiment, the toner 8 inside the toner bottle 7 can be efficiently replenished to the developer container 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-084134, filed Apr. 16, 2015, No. 2016-029601, filed Feb. 19, 2016, which are hereby incorporated by reference herein in their entirety.

What is claimed is:

1. A developing apparatus comprising:

a rotary shaft member including a rotary axis;

a sheet member having an inner edge secured by the rotary shaft member and including:

a first developer conveying portion which conveys developer by a plurality of first holes in a first direction along a rotary shaft of the rotary shaft member, and a second developer conveying portion which conveys the developer by a plurality of second holes in a second direction opposite to the first direction along the rotary shaft, the second developer conveying portion being disposed at a position closer to the rotary shaft member than the first developer conveying portion; and a reinforcing unit which is provided as an independent body from the sheet member and reinforces the sheet member, wherein the reinforcing unit includes:

a first reinforcing portion extending from the rotary axis in a radial direction from the rotary axis thereof and disposed so that an edge of the first reinforcing portion farthest from the rotary axis overlaps in the radial direction with a region where the first holes are disposed; and a second reinforcing portion extending radially from the rotary axis in a radial direction of the rotary axis thereof and disposed so that an edge of the second reinforcing portion farthest from the rotary axis overlaps in the radial direction with a region where the second holes are disposed.

2. The developing apparatus according to claim 1, wherein the first reinforcing portion is disposed on both axial end portions of the sheet member.

3. The developing apparatus according to claim 1, wherein the first reinforcing portion and the second reinforcing portion secure the sheet member at a location where the first holes and the second holes not disposed.

4. The developing apparatus according to claim 3, wherein a shape of each of the plurality of holes has a triangular shape or a trapezoidal shape in which an opening width increases in a conveying direction of the developer.

5. An image forming apparatus which develops an electrostatic latent image formed on an image bearing member by a developing apparatus and forms an image, comprising the developing apparatus according to claim 1 as the developing apparatus.

6. The developing apparatus according to claim 1, wherein the first reinforcing portion and the second reinforcing portion have different rigidity from each other.

7. The developing apparatus according to claim 6, wherein the first reinforcing portion and the second reinforcing portion have different lengths from each other.

8. The developing apparatus according to claim 7, wherein the first reinforcing portion has a length longer than a length of the second reinforcing portion, and a plurality of the first reinforcing portions are disposed at positions for reinforcing at least both axial end portions and a central portion of the sheet member.

9. A developing apparatus comprising:

a rotary shaft member including a rotary axis; and a sheet member having an inner edge secured by the rotary shaft member and including:

a first developer conveying portion and a second developer conveying portion, the first developer conveying portion conveys developer in a first direction along a rotary shaft of the rotary shaft member, the second developer conveying portion conveying the developer in a second direction opposite to the first direction along the rotary shaft, the second developer conveying portion being disposed at a position closer to the rotary shaft member than the first developer conveying portion, at least a part of the second developer conveying portion overlapping the first developer conveying portion in an axial direction of the rotary shaft member;

wherein each the first developer conveying portion and the second developer conveying portion is provided with;

a projecting portion which is formed on the sheet member and projecting in a direction of the rotary axis, and a hole which is formed on the sheet member, the hole being configured with openings beside an inner side and an outer side of the projecting portion in a radial direction of the rotary axis and another opening beside a leading portion of the projecting portion, wherein the hole of the first developer conveying portion and the hole of the second developer conveying portion do not overlap in the radial direction of the rotary axis.

10. The developing apparatus according to claim 9, further comprising a reinforcing unit which reinforces the first and second developer conveying portions.

11. The developing apparatus according to claim 9, wherein a width of the leading portion of the projecting portion is smaller than a width of a base portion of the projecting portion.

12. The developing apparatus according to claim 9, wherein the sheet member is disposed parallel to the rotary shaft.

13. The developing apparatus according to claim 9, wherein a shape of the holes on the first developer conveying portion and a shape of the holes on the second developer conveying portion are the same shape.

14. A developing apparatus comprising:

a rotary shaft member including a rotary axis;

a sheet member having an inner edge secured by the rotary shaft member and a single free edge in a radial direction of the rotary axis, and including:

a first developer conveying portion and a second developer conveying portion, the first developer conveying portion conveys developer in a first direction along a rotary shaft of the rotary shaft member, the second developer conveying portion conveys the developer in a second direction opposite to the first direction along the rotary shaft, the second developer conveying portion being disposed at a position closer to the rotary shaft member than the first developer conveying portion; and a reinforcing unit which is provided as an independent body from the sheet member and reinforces the sheet member, wherein the reinforcing unit includes:

edge reinforcing portions which reinforces both ends of the single free edge in a direction along the rotary shaft, and an inner reinforcing portion which is disposed between the edge reinforcing portions in the direction along the rotary shaft and is shorter in length than the edge reinforcing portions in the radial direction of the rotary axis.

* * * * *